US005356273A

United States Patent [19]

Nixon

[11] Patent Number: 5,356,273

[45] Date of Patent: Oct. 18, 1994

[54] RADIAL BEARING ASSEMBLY FOR A HIGH INERTIA FLYWHEEL OF A CANNED PUMP

[75] Inventor: Donald R. Nixon, Murraysville, Pa.

[73] Assignee: Westinghouse Electric Corporation, Pittsburgh, Pa.

[21] Appl. No.: 175,866

[22] Filed: Dec. 30, 1993

[51] Int. Cl.[5] ..... F04B 17/00

[52] U.S. Cl. ..... 417/423.12; 417/423.13; 417/370; 74/572

[58] Field of Search ..... 417/423.12, 423.13, 417/357, 369, 370, 902; 74/572

[56] References Cited

U.S. PATENT DOCUMENTS

| | | | |
|---|---|---|---|
| 3,450,056 | 6/1969 | Heathcote et al. | 417/423.12 |
| 3,691,413 | 9/1972 | Russell | 74/572 |
| 4,084,924 | 4/1978 | Ivanoff et al. | 74/572 |
| 4,886,430 | 12/1989 | Veronesi et al. | 417/423.13 |

*Primary Examiner*—Richard A. Bertsch

*Assistant Examiner*—Michael Kocharov

[57] ABSTRACT

A canned pump is described which includes a motor, an impeller, a rotatable shaft, and a high inertia flywheel mounted on the shaft and within a hermetically sealed housing. The flywheel comprises a heavy metal disk made preferably of a uranium alloy and having an inner circumferential annular recess portion. One embodiment employs a radial bearing assembly mounted to a bearing housing member, which also carries a thrust bearing assembly, for bearing surface contact with the inner circumferential surface of a stepped portion of the flywheel assembly. A second embodiment employs a radial bearing assembly mounted on the bearing housing member for bearing surface contact with a journal on the outer surface of the shaft. These arrangements locate the radial bearing assembly within the vicinity of the inner circumferential annular recess portion of the flywheel.

9 Claims, 3 Drawing Sheets

RADIAL BEARING ASSEMBLY FOR A HIGH INERTIA FLYWHEEL OF A CANNED PUMP

BACKGROUND OF THE INVENTION

This invention relates generally to a canned pump with a high inertia flywheel, and more particularly, to an arrangement, and/or location of a radial bearing assembly relative to a motor shaft on which the flywheel is mounted.

Centrifugal pumps having flywheels are well-known. The flywheel is incorporated to mechanically store potential energy during operation of the pump, which energy may be utilized to maintain rotation of the pump in the event of loss of motive power, such as loss of electric power. In nuclear reactors, this technology becomes very important in order to help maintain coolant circulation through the reactor core after coolant pump trip, since the nuclear fuel continues to give off substantial amounts of heat within the first several minutes after a reactor trip, and cooling is improved with forced flow. The flywheel is generally a metal disk having relatively high mass and being precisely attached to or mounted on the motor shaft for rotation therewith, the inertia of which keeps the shaft rotating after de-energization of the motor.

Pressurized water reactor (PWR) coolant pumps generally include a pump and motor being separated by a complicated shaft seal system, the seals being used as a part of the reactor coolant system pressure boundary. The seals are generally subject to about a 2500 psi pressure differential between the reactor coolant system and the containment atmosphere. These seals are susceptible to failure, and may cause a non-isolable leak of primary coolant ranging in size from very small to fairly large. As such, seal failure may result in a challenge to the redundant safety systems provided in nuclear power plants to prevent and mitigate damage to the reactor core.

Canned pumps have been used in nuclear reactor plants for some time, and avoid the problem of the shaft seal arrangement since the entire pump, including bearings and rotor, are submerged in the pumped fluid. Therefore, the use of the pump expressly reduces the potential for a small loss of coolant accident (LOCA). Exemplary canned motor pumps are described in U.S. Pat. Nos. 3,450,056 and 3,475,631. In boiling water reactors, continued rotation of these pumps upon loss of electric power is provided by electro-mechanical means, generally in the form of motor-generator sets having flywheels incorporated therein. The motor-generator set is generally located outside of the reactor containment for accessibility purposes, the electricity being transmitted from the generator to the pump motor through containment wall penetrations. In the event of a loss of electric power to the motor-generator set, the flywheel maintains rotation of the generator for some period of time, which continues to provide power to the pump motor. However, due to the lack of mechanical inertia in the pump itself, any localized failures of the pump or its controls may prevent the pump from extended coast-down. In addition, due to the necessity for extra equipment, this option becomes fairly expensive, both in capital cost and in operation and maintenance cost.

A flywheel within a canned or wet winding pump has been utilized. However, the losses resulting from spinning a large, high mass flywheel through the fluid contained in the pump casing are substantial. The outer surfaces of the flywheel attempt to frictionally pump the surrounding fluid, while the casing surrounding the flywheel inhibits fluid flow. Therefore, turbulent vortices form causing highly distorted fluid velocities which yields substantial drag on the flywheel. This drag is a function of the speed and area of the surface of the flywheel, which both increase with the radius of the flywheel, such drag being commonly understood to increase with about the fifth power of the diameter and about the cube of the angular velocity.

One arrangement to overcome this power loss is disclosed in U.S. Pat. No. 4,084,924 to Ivanoff et al. This patent describes a wet winding pump having a flywheel and a free-wheeling shroud rotatable relative to the shaft and the flywheel. The shroud encompasses the flywheel but is spaced apart therefrom and includes passages for ingress and egress of liquid into and out of the space between the flywheel and the shroud. This system envisions that the shroud will rotate at some angular velocity which would be approximately one-half the velocity of the flywheel, thereby creating two pumped fluid layers, one (between the flywheel and the shroud) being pumped by the flywheel, and the other (the layer outside the shroud) being pumped by the shroud. The lower relative angular velocity between the rotating surfaces therefore results in lower total drag.

A further high inertia flywheel for a canned or wet winding pump that purportedly prevents vibration of the pump, and simultaneously minimizes the drag losses associated with the flywheel is disclosed in U.S. Pat. No. 4,886,430 to Veronesi et al. on Dec. 12, 1989, assigned to the Westinghouse Electric Corporation. U.S. Pat. No. 4,886,430 describes a radial bearing located on the outer circumferential surface of the flywheel. The small gaps between the flywheel surface facings and the radial and thrust bearing surfaces were theorized as reducing the friction loss of the flywheel. However, testing of the flywheel and bearing arrangement described in this U.S. Pat. No. 4,886,430 showed that the expected drag reduction did not occur. Subsequent analysis revealed that close clearances, such as those in journal bearings, increase rather than reduce drag. The analysis was proven by testing that showed a 30% drag reduction when the close clearance radial bearing pads were replaced with a continuous stationary cylinder with a half inch gap between the cylinder and the outer diameter of the flywheel. U.S. Pat. No. 4,886,430 also assumed that vibration would be decreased or eliminated. Again, subsequent analysis showed that the rotor was dynamically unstable, most likely due to the relatively light unit loading and thick hydrodynamic film associated with such a large radial bearing which, if too thick of a film, causes the rotor to "wander" around within the bearing.

In view of the shortcomings of the flywheel radial-bearing arrangement of the above U.S. Pat. No. 4,886,430, it was decided by the personnel of Westinghouse Electric Corporation to provide a radial bearing having a smaller radius than that discussed in U.S. Pat. No. 4,886,430 with at least a one-half inch radial clearance around the outer diameter of the flywheel. This entailed placing the radial bearing adjacent to the flywheel along the shaft.

A disadvantage of this arrangement was that the overall length of the motor was increased in view of the added length of the shaft and bearing housing accommodating the radial bearing. This increase in length of the motor results in an increase in plant costs due to the increase in the depth of the pit housing the pump and to the added inventory of the water, which water must be provided inside the reactor containment in order to keep the reactor core covered in the event of a break in the pipes.

Ideally, a small diameter radial bearing and a greater clearance around the outer diameter of a flywheel while still maintaining the normal length of a canned motor pump would eliminate the problems associated with the prior art.

SUMMARY OF THE INVENTION

Therefore, it is a primary object of the invention to provide a high-inertia flywheel for a canned or wet winding pump that minimizes drag and rotor instability with no increase in the overall length of the motor.

The arrangement of the present invention locates the radial bearing on the shaft inside the inner circumference of the flywheel rather than on the outside diameter of the flywheel as disclosed in the U.S. Pat. No. 4,886,430 as discussed hereinabove, or adjacent to the flywheel as discussed hereinabove.

The flywheel, preferably, has a stepped inner circumferential surface, and the shaft has a circumferential surface which may carry a radial journal. This arrangement allows a radial bearing assembly to be mounted inside the inner circumference of the flywheel. The radial bearing assembly is carried by a bearing housing member which also carries a thrust bearing assembly. The bearing housing member is stationarily mounted to an inner annular member which, in turn, is stationarily fixed to an outer housing for the motor of the canned pump. In a first embodiment, the radial bearing assembly is mounted on the bearing housing member for bearing surface contact with the inner circumferential surface of the stepped portion of the rotary flywheel assembly. In a second embodiment the radial bearing assembly is mounted on the bearing housing member for bearing surface contact with a journal on the outer circumferential surface of the rotary shaft.

BRIEF DESCRIPTION OF THE DRAWING

The invention will become more readily apparent from the following description of the preferred embodiment as illustrated in the accompanying drawings wherein.

DETAILED DESCRIPTION OF THE PREFERRED EMBODIMENT

The present invention finds particular application in a canned reactor coolant pump of an advanced pressurized water reactor primary coolant system, which operates and is constructed similar to that discussed in U.S. Pat. No. 4,886,430, which is incorporated herein by reference.

Figure 1:
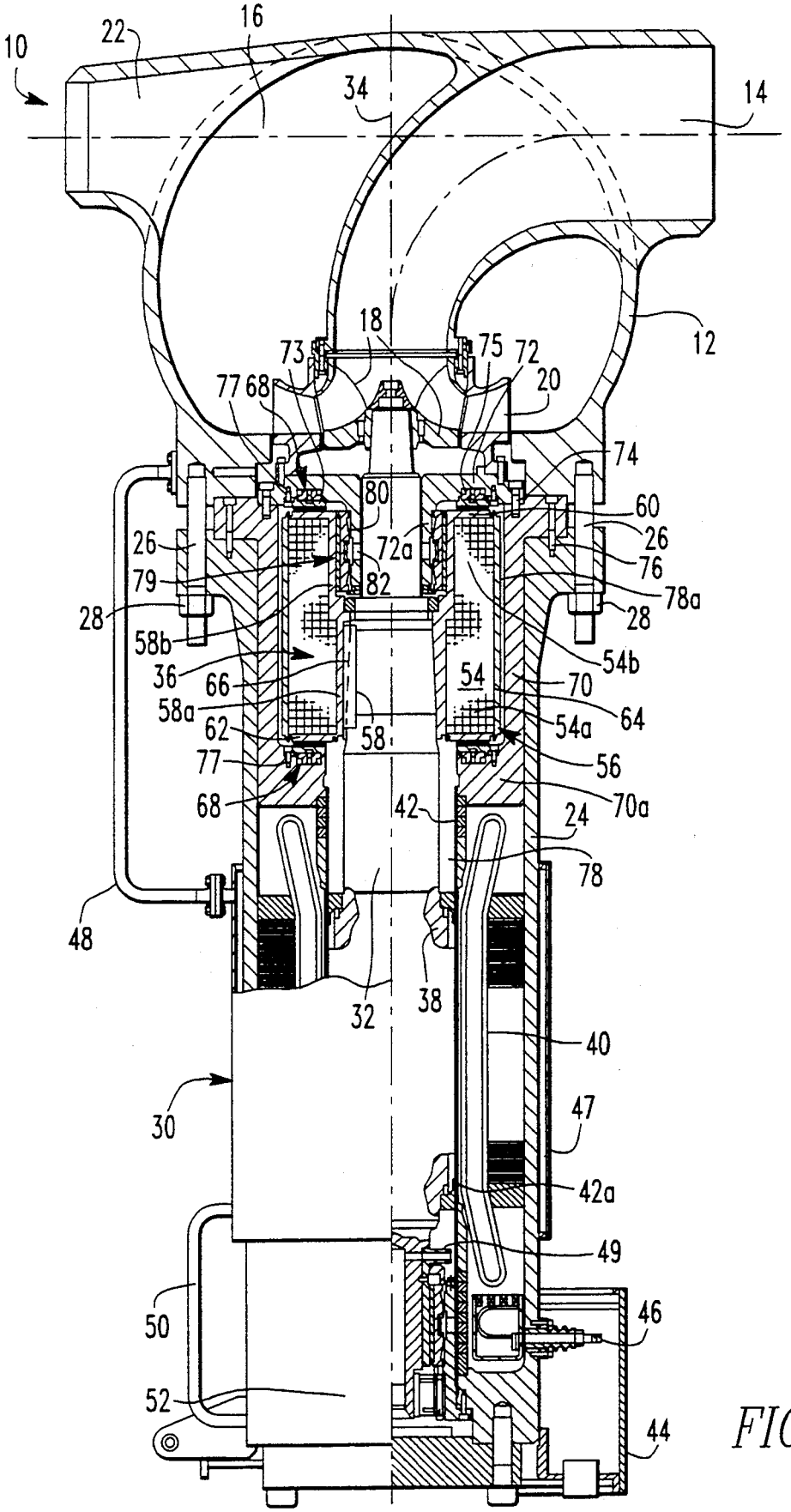
FIG. 1 is an elevational view, partially in section, of a canned reactor coolant pump showing a first embodiment of the present invention entailing a high inertia flywheel with a first arrangement for a radial bearing assembly.

Referring to FIG. 1, there is shown a canned motor single-stage centrifugal reactor coolant pump 10 employing a first embodiment of the present invention. The pump 10 includes a pump casing 12 defining suction section 14 and discharge section 16, and having an impeller 18 for centrifugally pumping the coolant fluid, whereby water is drawn through the eye of the impeller, discharged through the diffuser 20 into the pump casing 12 and out through the discharge nozzle 22 in the side of the casing 12.

pump 10 includes a hermetically sealed housing 24 removably mounted to the pump casing 12 by a plurality of studs 26 and nuts 28. Pump 10 further includes a motor 30 for driving impeller 18 via a rotatable shaft 32 about pump centerline axis 34, and a high inertia flywheel assembly 36 mounted on shaft 32 between motor 30 and impeller 18 for mechanical storage of potential energy to be used to continue to rotate shaft 32 if motor 30 becomes deenergized.

Motor 30 has a rotor assembly 38 mounted on shaft 32, a stator assembly 40, and a corrosion resistant stator can 42 separating the stator 40 from the rotor 38, defining the fluid pressure boundary within the pump 10 and also defining a narrow annulus of fluid between the stator can 42 and the outer diameter of the rotor 38. Electrical connections are made in the terminal box 44, with connections to the stator assembly 40 passing through the housing 24 via terminal assemblies 46.

Pump 10 also includes a water jacket 47 for receiving a coolant water flow through cooling pipes 48 and 50 for keeping the internal water temperature of motor 30 relatively cool at about 150° F.

Fluid, at a total flow rate of about 150 gpm, is passed from the casing 12 to the jacket 47 through cooling pipes 48. The fluid flows through jacket 47 into cooling pipes 50, then to the lower end 52 of motor 30. It is then passed through the rotor 38 and an annulus 42a of stator can 42, being circulated by a small centrifugal auxiliary pump impeller 49, the details of which are not necessary for an understanding by those skilled in the art. After passing flywheel assembly 36 as described below, the fluid is returned to casing 12. Stator 40 lies outside of stator can 42 and inside housing 24, this area normally being dry. However, housing 24 is designed such that a breach of stator can 42 will not cause failure or leakage of fluid from motor housing 24.

Flywheel assembly 36 will now be discussed in greater detail with particular reference to FIGS. 1 and 2. Flywheel assembly 36 comprises a disk 54, which is preferably made of a metal having very high density, such as uranium, tungsten, or an alloy of one of these elements, chosen such as to yield the desired inertia. The metal chosen will preferably have a high yield strength, such as in excess of about 60,000 psi; and should be non-brittle, so that the forces exerted on the disk 54 from rotation will not cause failure or excessive deformation of the disk 54. One preferable embodiment is a uranium alloy with about 2 percent by weight molybdenum, a high density alloy having a minimum yield strength of about 65,000 psi and an elongation of about 22 percent.

In the embodiment described herein, disk 54 has an outer diameter of about 26 inches to 30 inches and, preferably 28 inches. A lower portion of disk 54 indicated at 54*a* has an inner diameter of about 8 inches to 10 inches, and preferably 9 inches, and an upper portion 54*b* of disk 54 has an inner diameter of about 15 to 17 inches, and preferably 16 inches. The total length of disk 54 is about 27 to 29 inches and preferably 28 inches. The length of lower portion 54*a* of disk 54 with the smaller inner diameter is about 14 to 16 inches, and the length of upper portion 54*b* with the larger inner diameter is about 12 to 14 inches. Lower portion 54*a* and upper portion 54*b* of disk 54 are such that they form a stepped configuration for the inner diameter of disk 54.

Disk 54 is enclosed in a stainless steel shell 56 comprised of an inner diameter annular shell 58 disposed around shaft 32 for mating with shaft 32, a first end plate 60, a second end plate 62, and an outer circumferential plate 64. Plates 58, 60, 62 and 64 are welded together to sealably enclose disk 54, thereby preventing corrosion or erosion of the heavy metal.

Inner diameter shell 58 has a lower portion 58*a* and an upper portion 58*b* having different inner and outer diameters to form a stepped configuration to mate with the stepped portions 54*a* and 54*b* along the inner diameter of disk 54. The inner diameter of lower portion 58*a* of annular shell 58 mates with and is keyed by one or more keys 66 to shaft 32, as is known to those skilled in the art for joining flywheels to shafts.

The first end plate 60 and the second end plate 62 lie generally perpendicular to shaft 32, and the surfaces are used as thrust runners. As such, thrust bearing means 68 are disposed on an outer annular member 70 and an inner annular member or bearing housing member 72, which are interconnected by a plurality of bolts 74, and which outer annular member 70 is stationarily fastened to housing 24 by a plurality of bolts 76. Members 70 and 72 and housing 24 are stationarily fixed, and allow shaft 32 and flywheel assembly 36 to rotate within assembled members 70 and 72 and housing 24.

The lower portion 70*a* of outer annular member 70 is connected to the top part of stator housing 24 to form part of an annular channel opening 78 around shaft 32 and an annular channel opening 78*a* around flywheel assembly 36, into which the coolant flows.

Thrust bearing means 68 at both ends of disk 54 flywheel assembly 36 are disposed to mate with plates 60 and 62, and includes a plurality of thrust bearing shoes 73 on each side of the flywheel assembly 36 which are mounted to outer annular member 70 and inner annular member 72 by thrust links 75 and thrust shoe retainers 77. Thrust links 75 generally include primary and secondary links which provide self levelling and load equalization for the thrust bearing shoes 73, which is common in the art, and does not need to be detailed for a thorough understanding of the present invention. Thrust bearings 68 absorb forces exerted along the longitudinal axis of pump 10 and minimize movement along the axis 34 of rotary shaft 32.

Referring to flywheel assembly 36 and the inner diameter plate 58, the present invention includes the manner in which the inner circumferential area of disk 54 has a stepped configuration with inner diameter plate 58 conforming to the same stepped configuration, with upper portion 58*b* being utilized as a radial journal and mating with radial bearing means 79 which are mounted around a lower portion 72*a*.

Figure 2:
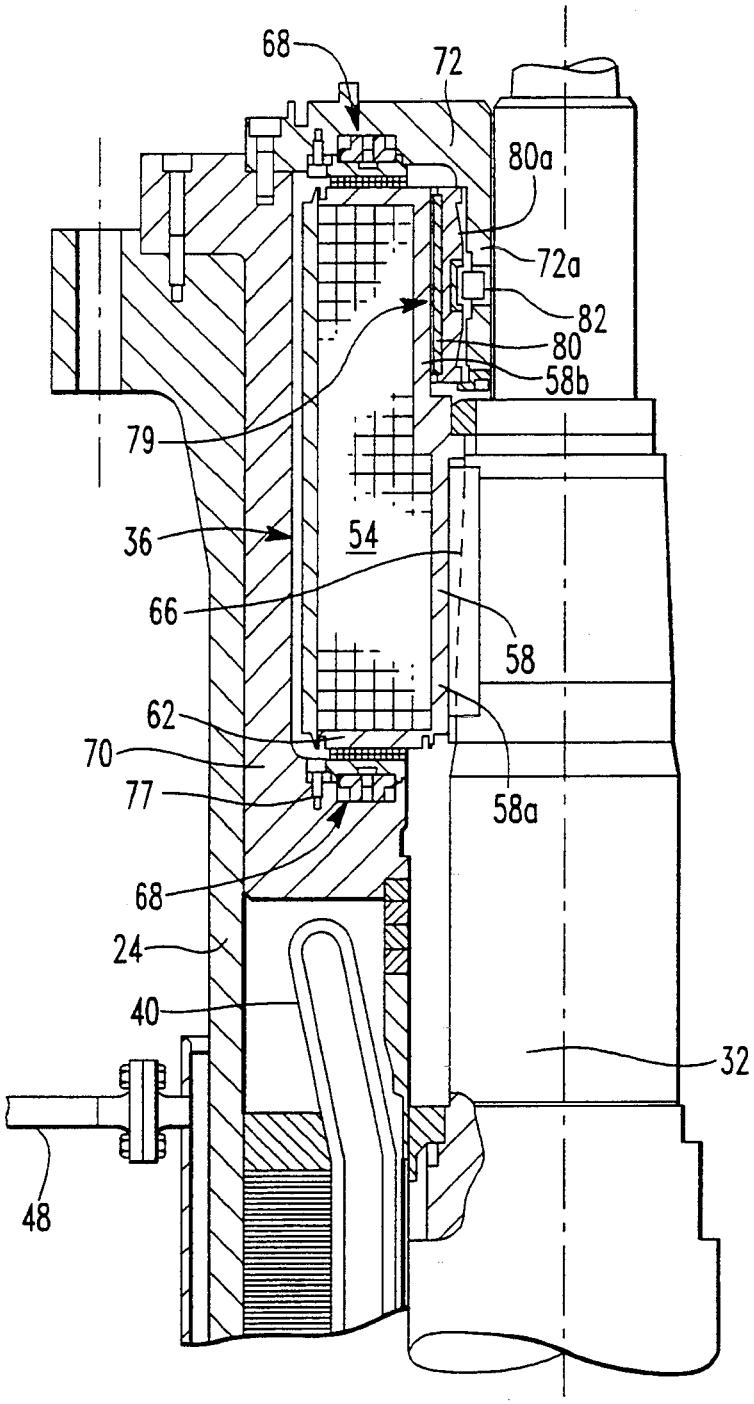
FIG. 2 is an enlarged cross-sectional, partial view showing the flywheel and the radial bearing assembly as viewed to the left of the centerline of the rotary shaft in FIG. 1.

As best shown in FIG. 2, radial bearing means 79 is comprised of a plurality of radial pad assemblies or bearing segments 80 and bearing member 80*a* disposed about the periphery of the lower portion 72*a* of inner annular member or bearing housing 72. Each segment 80 and bearing member 80*a* is mounted to inner annular member 72 by precipitation hardened stainless steel radial pivot pins 82 which allow vertical and circumferential tilt capability for alignment and hydrodynamic film generation between segment 80 and bearing member 80*a* and upper portion 58*b* of inner diameter plate 58.

The thrust bearings means 68 may also be of the Kingsbury type, and the radial bearing means may be of the continuous cylinder type, which are well-known in the art.

From the foregoing, it is appreciated that inner annular member 72 houses both the thrust bearing means 68 for top plate 60 of flywheel assembly 36 and radial bearing means 79 for integrally mounting thrust bearing means 68 and radial bearing means 79 in motor 30. Additionally, the radial clearance between inner annular member 72 and flywheel assembly 36 is about 0.25 inches to about 0.50 inches and, preferably, 0.318 inches to provide an optimum clearance for producing low friction therebetween.

Figure 3:
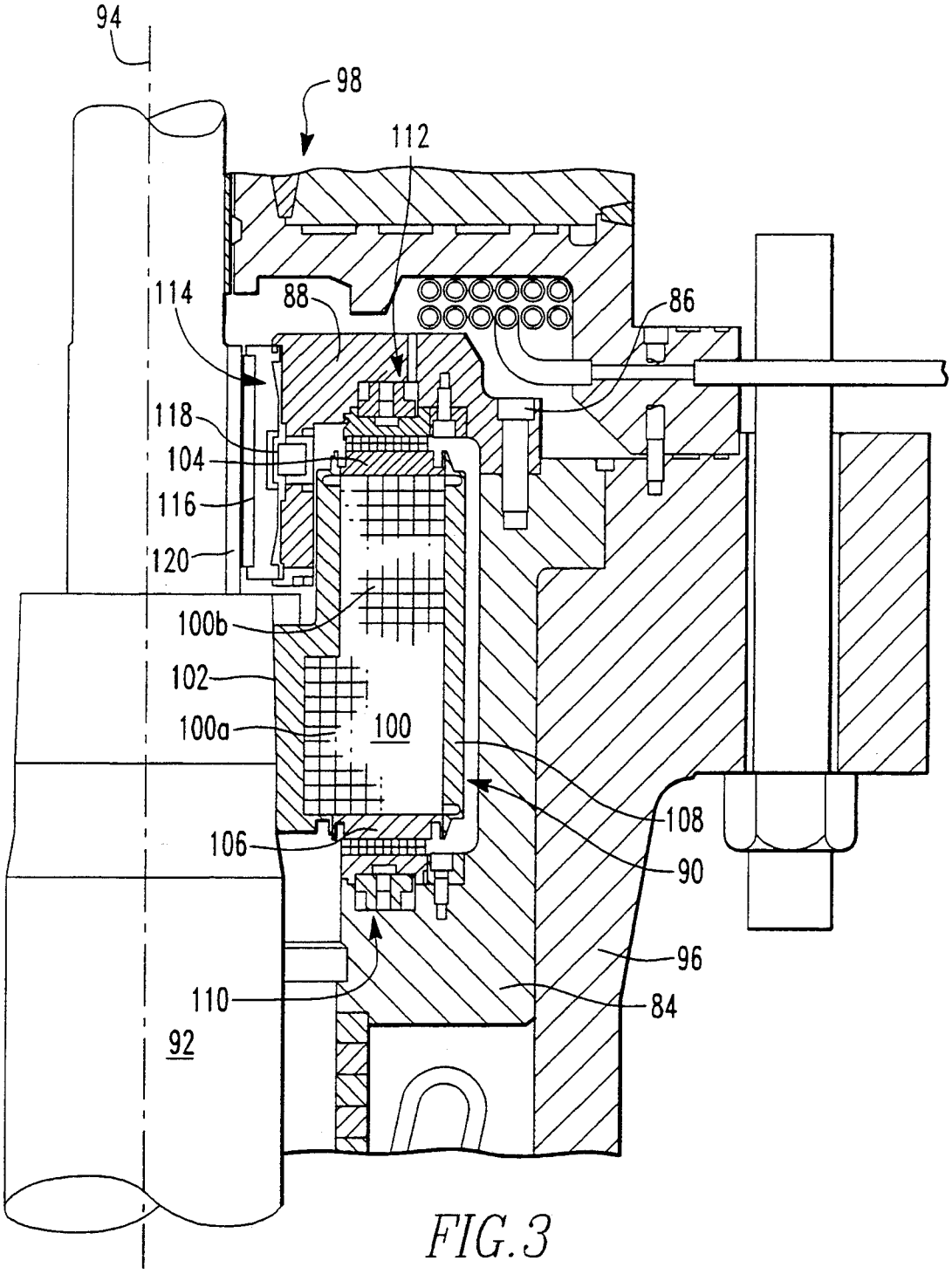
FIG. 3 is an enlarged, cross-sectional partial view of a second embodiment of the present invention showing a flywheel with a second arrangement for a radial bearing assembly as viewed to the right of the centerline of a rotary shaft of a coolant pump similar to that in FIG. 1.

FIG. 3 shows a second embodiment of the present invention which is in the same environment as the first embodiment but involves a different structural arrangement for a radial bearing assembly. This embodiment comprises an outer annular housing member 84 fastened by bolts 86 to an inner annular housing member 88, which members 84 and 88 cooperate to encase a flywheel assembly 90 mounted for rotation on rotary shaft 92 along a centerline axis 94 for rotation in outer housing 96 of a canned pump 98. Flywheel assembly 90 has a disk 100 with stepped portions 100*a* and 100*b* encased in an inner diameter annular plate 102 with stepped portions, a first end plate 104, a second end plate 106, and an outer annular member 108, similar to that of flywheel assembly 36 of FIGS. 1 and 2.

Outer annular housing member 84 carries a thrust bearing assembly 110, and inner annular housing member 88 carries a thrust bearing assembly 112 and a radial bearing assembly 114. Radial bearing assembly 114 is comprised of several bearing pads or segments 116 pivotally mounted by pins 118 to bearing housing member 88. A plain or full cylinder bearing may be used instead of the bearing pads or segments in a fashion well-known in the art. The shaft 92 carries a journal member 120, which acts as a contact bearing surface for radial bearing assembly 114.

In this embodiment of FIG. 3, the flywheel assembly 90 and the shaft 92 with journal member 120 rotate while the remaining components remain stationary. Also, as can be appreciated, the radial bearing assembly 114 is mounted inwardly of inner annular bearing housing member 88 for surface bearing contact with journal member 120 on the shaft 92, whereas in the embodiment of FIGS. 1 and 2, the radial bearing assembly 79 is mounted outwardly of bearing housing member 72 for surface bearing contact with flywheel assembly 36. However, both embodiments of the present invention locate the radial bearing assemblies 79 and 114 within the inner diameter of its respective flywheel assembly 36 and 90.

It can also be appreciated that in the embodiment of FIGS. 1–2, both the thrust bearing assembly 68 and the radial bearing assembly 79 are mounted or carried by stationary bearing housing member 72, and that in the embodiment of FIG. 3, both thrust bearing assembly 112 and radial bearing assembly 114 are mounted in the same stationary bearing housing 88.

The mounting of radial bearing means 79 and 114 within the inner circumference of flywheel assemblies 36 and 90, respectively, reduces the rotor and, therefore, the motor length, and the span between the radial bearings allows high speeds of the rotor and flywheel assemblies 36 and 90, say about 1800 to 3600 revolutions per minute, and provides higher rotor critical speed compared to the radial bearing being located adjacent to the flywheel, as discussed hereinabove as being prior art, and better rotor dynamic stability due to the more appropriate film thickness than when the radial bearing is located on the outer diameter of the flywheel as discussed hereinabove as being prior art.

It will be apparent that many modifications and variations are possible in light of the above teachings. It, therefore, is to be understood that within the scope of the appended claims, the invention may be practiced other than as specifically described.

I claim:

1. A pump comprising:

a shaft assembly having an outer circumferential surface means, an impeller mounted on said shaft assembly for pumping a fluid;

drive means engaged with said shaft assembly for turning said impeller;

a flywheel assembly having inner circumferential surface means and mounted on said shaft with an annular recess between one end of said flywheel assembly and said shaft assembly, and radial bearing means located in said annular recess and contacting one of said circumferential surface means of said flywheel assembly and said shaft assembly.

2. A pump according to claim 1, further comprising bearing housing means for carrying said radial bearing means and for locating said radial bearing means in said annular recess for engagement of said radial bearing means with said circumferential surface means of said shaft assembly.

3. A pump according to claim 1, further comprising bearing housing means for carrying said radial bearing means and for locating said radial bearing means in said annular recess for engagement of said radial bearing means with said circumferential surface means of said flywheel assembly.

4. A pump according to claim 1, further comprising:

stationarily mounted bearing housing means for carrying said radial bearing means and including leg means extending parallel to said shaft assembly for mounting said radial bearing means outwardly of said leg means and in said annular recess for contacting of said radial bearing means with said circumferential surface means of said flywheel assembly.

5. A pump according to claim 1, further comprising:

stationarily mounted bearing housing means for carrying said radial bearing means and including leg means extending parallel to said shaft assembly for mounting said radial bearing means inwardly of said leg means and in said annular recess for contacting of said radial bearing means with said circumferential surface means of said shaft assembly.

6. A pump according to claim 1 further comprising thrust bearing means bearing against at least one end of said flywheel assembly, and bearing housing means for carrying said radial bearing means and said thrust bearing means for said at least one end of said flywheel assembly.

7. A pump according to claim 6, said bearing housing means being stationarily mounted in said pump.

8. A pump according to claim 1, wherein said annular recess is formed in said inner circumferential surface means of said flywheel assembly.

9. A pump according to claim 1, wherein said inner circumferential surface means of said flywheel assembly has at least two stepped portions, and wherein said annular recess is formed by said two stepped portions.

* * * * *